US009999956B2

(12) United States Patent
Namiki et al.

(10) Patent No.: US 9,999,956 B2
(45) Date of Patent: Jun. 19, 2018

(54) POLISHING DEVICE AND POLISHING METHOD

(71) Applicant: Ebara Corporation, Tokyo (JP)

(72) Inventors: Keisuke Namiki, Tokyo (JP); Hozumi Yasuda, Tokyo (JP); Osamu Nabeya, Tokyo (JP); Makoto Fukushima, Tokyo (JP); Shingo Togashi, Tokyo (JP); Satoru Yamaki, Tokyo (JP); Shintaro Isono, Tokyo (JP)

(73) Assignee: Ebara Corporation, Tokyo (JP)

( * ) Notice: Subject to any disclaimer, the term of this patent is extended or adjusted under 35 U.S.C. 154(b) by 44 days.

(21) Appl. No.: 14/672,747

(22) Filed: Mar. 30, 2015

(65) Prior Publication Data

US 2015/0273650 A1 Oct. 1, 2015

(30) Foreign Application Priority Data

Mar. 31, 2014 (JP) ..... 2014-074481

(51) Int. Cl.
*B24B 37/015* (2012.01)
*B24B 37/32* (2012.01)
(Continued)

(52) U.S. Cl.
CPC ..... *B24B 37/015* (2013.01); *B24B 37/32* (2013.01); *B24B 37/345* (2013.01);
(Continued)

(58) Field of Classification Search
CPC ..... B24B 37/015; B24B 37/32; B24B 49/12; B24B 37/345; B24B 49/003; B24B 49/105; B24B 37/005
See application file for complete search history.

(56) References Cited

U.S. PATENT DOCUMENTS 6,390,908 B1 * 5/2002 Chen ..... B24B 49/12 451/288
6,923,709 B2 * 8/2005 Chen ..... B24B 49/00 451/289
(Continued)

FOREIGN PATENT DOCUMENTS

CN 1728343 A 2/2006
CN 101396805 A 4/2009
(Continued)

OTHER PUBLICATIONS

Japan Patent Office, Notification of Reasons for Refusal in Japanese Patent Application No. 2014-074481 (dated Mar. 6, 2018).
(Continued)

*Primary Examiner* — Christopher M Koehler
*Assistant Examiner* — Joel Crandall
(74) *Attorney, Agent, or Firm* — Leydig, Voit & Mayer, Ltd.

(57) ABSTRACT

A polishing device is provided to suppress deterioration in reproducibility of a polishing profile due to a variation or change with time of a shape of a retaining ring of a substrate holding member for each of retaining rings. The polishing device includes: a polishing head configured to press a substrate against a polishing pad and have a retainer ring surrounding the substrate pressed against the polishing pad; a measurement sensor configured to measure a surface shape of the retainer ring; and a controller configured to determine a polishing condition of the substrate based on the surface shape of the retainer ring measured by the measurement sensor.

21 Claims, 11 Drawing Sheets

(51) Int. Cl.

| | |
|---|---|
| ***B24B 37/34*** | (2012.01) |
| ***B24B 49/00*** | (2012.01) |
| ***B24B 49/10*** | (2006.01) |
| ***B24B 49/12*** | (2006.01) |

(52) U.S. Cl.
CPC ..... *B24B 49/003* (2013.01); *B24B 49/105* (2013.01); *B24B 49/12* (2013.01)

(56) References Cited

U.S. PATENT DOCUMENTS

| | | | | |
|---|---|---|---|---|
| 2002/0037681 | A1* | 3/2002 | Gitis | B24B 37/013 451/5 |
| 2006/0205323 | A1 | 9/2006 | Togawa et al. | |
| 2007/0243796 | A1* | 10/2007 | Torii | B24B 37/32 451/5 |
| 2008/0119120 | A1 | 5/2008 | Zuniga et al. | |
| 2012/0021671 | A1* | 1/2012 | McReynolds | B24B 37/005 451/6 |

FOREIGN PATENT DOCUMENTS

| | | | |
|---|---|---|---|
| EP | 1 066 925 | A3 | 1/2001 |
| JP | H11-204472 | A | 7/1999 |
| JP | 2001-60572 | | 3/2001 |
| JP | 2004-249452 | A | 9/2004 |
| JP | 2005-026453 | A | 1/2005 |
| JP | 2005-305587 | A | 11/2005 |
| JP | 2006-043873 | | 2/2006 |
| JP | 2006-128582 | | 5/2006 |
| JP | 2007-287787 | A | 11/2007 |
| JP | 2009-260142 | A | 11/2009 |
| JP | 4689367 | | 2/2011 |
| JP | 2013-532588 | | 8/2013 |

OTHER PUBLICATIONS

The State Intellectual Property Office of People'S Republic of China, First Office Action in Chinese Application No. 201510148861.9 (dated Feb. 23, 2018).

* cited by examiner

POLISHING DEVICE AND POLISHING METHOD

CROSS-REFERENCE TO RELATED APPLICATIONS

This application claims the benefit of Japanese Priority Patent Application JP 2014-074481 filed on Mar. 31, 2014, the entire contents of which are incorporated herein by reference.

FIELD

The present technology relates to a polishing device that polishes a substrate by pressing the substrate against a polishing pad using a substrate holding member including a retaining ring and a method thereof.

BACKGROUND AND SUMMARY

In a polishing device, a substrate held on a substrate holding member is rotated, and the substrate is pressed against a rotating polishing pad such that a surface of the substrate is polished. In this instance, the substrate holding member is provided with a retaining ring that surrounds the substrate which is being polished in order to prevent the substrate from leaving a position for polishing. The retaining ring surrounds the substrate which is pressed against the polishing pad, and a bottom face of the retaining ring is pressed against the polishing pad. In this instance, a pressing force of a bottom face of the retaining ring applied to the polishing pad affects a polishing profile of a substrate edge portion.

However, even when the substrate is polished by setting the pressing force of the retaining ring applied to the polishing pad to a predetermined value, the substrate edge portion may not have a desired polishing profile due to a three-dimensional (3D) shape of the bottom face of the retaining ring. The reason is considered to be that a different pressing force of the retaining ring is applied to the polishing pad and the polishing pad has a different rebound state in a portion near the substrate edge portion due to the 3D shape of the bottom face of the retaining ring even when the pressing force of the retaining ring is set to a predetermined pressure.

In addition, when retaining rings are manufactured, a 3D shape of a bottom face varies for each of the retaining rings depending on a condition of precision during a machining process. Thus, when a retaining ring is replaced with a new retaining ring, a polishing profile formed before the replacement may not be reproduced. With regard to a shape of an inner circumferential surface of the retaining ring; it is generally known that change with time during use affects the polishing profile, in particular, the polishing profile in a portion near a substrate edge.

A scheme of completing a 3D shape of a bottom face of a retaining ring through a break-in of the retaining ring by polishing a dummy substrate using an actual machine, a scheme of previously processing a bottom face of a retaining ring into a 3D shape which is formed after completing a break-in by machining, and the like have been adopted as conventional schemes for solving the above-mentioned problem.

However, the conventional schemes have problems below. First, a processing accuracy of the retaining ring needs to be raised, and thus cost increases. In addition, when the break-in is performed, a rate of operation of an apparatus decreases, and costs of a dummy substrate, slurry, and the like are incurred. Further, in a semiconductor manufacturing site, a polishing condition may be changed according to a type of a product. However, strictly speaking, the 3D shape of the bottom face of the retaining ring is changed according to a type of process or a polishing condition. Therefore, in practice, it is difficult to control a shape in a rigorous manner.

It is desired to suppress deterioration in reproducibility of a polishing profile due to a variation or change with time of a shape of a retaining ring of a substrate holding member for each of retaining rings.

A polishing device of an embodiment includes a substrate holding member configured to press a substrate against a polishing pad and have a retaining ring surrounding the substrate pressed against the polishing pad, a sensor configured to measure a surface shape of the retaining ring, and a controller configured to determine a polishing condition of the substrate based on the surface shape of the retaining ring measured by the sensor. According to this configuration, a surface shape of a retainer ring is measured, and the polishing condition of the substrate is determined based on the measured surface shape, and thus it is possible to reduce influence by a variation or change with time of the surface shape of the retainer ring.

A polishing method of an embodiment includes a polishing process of polishing a substrate by relatively moving the substrate and a polishing pad in a state in which the substrate is surrounded by a retaining ring and pressed against the polishing pad, a measurement process of measuring a surface shape of the retaining ring, and a control process of determining a polishing condition in the polishing process based on the surface shape of the retaining ring measured in the measurement process, wherein in the polishing process, the substrate is polished according to the polishing condition determined in the control process.

DETAILED DESCRIPTION OF NON-LIMITING EXAMPLE EMBODIMENTS

Figure 1:
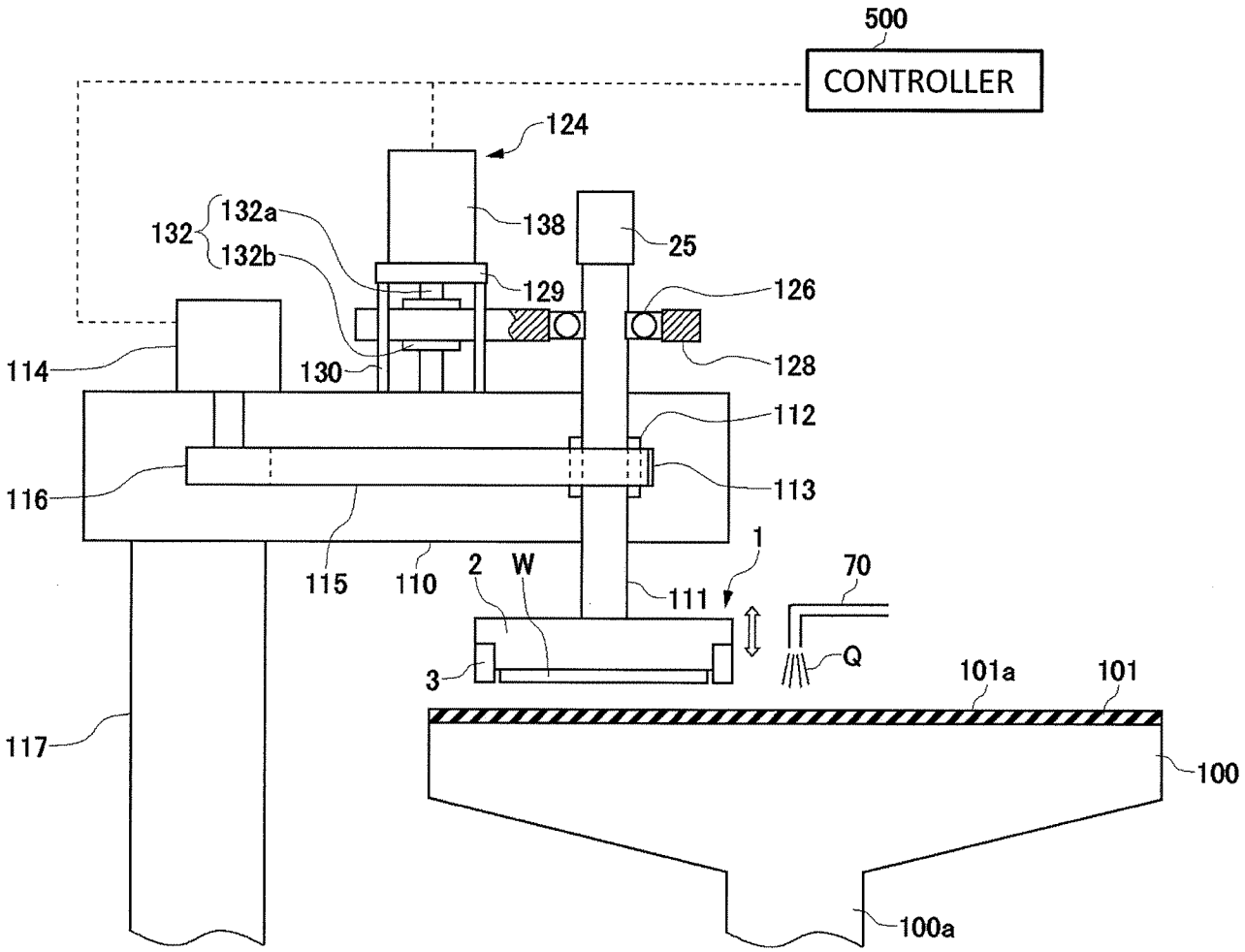
FIG. 1 is a diagram schematically illustrating an overall configuration of a polishing device according to an embodiment.

Hereinafter, a description will be given of a polishing device of an embodiment. The embodiment described below shows an example when the present technology is implemented, and does not limit the present technology to specific configurations described below. At the time of implementing the present technology, a specific configuration according to an embodiment may be appropriately employed.

The polishing device of the embodiment has a configuration including a substrate holding member which presses a substrate against a polishing pad and has a retaining ring surrounding the substrate pressed against the polishing pad, a sensor for measuring a surface shape of the retaining ring, and a controller for determining a polishing condition of the substrate based on the surface shape of the retaining ring measured by the sensor. According to this configuration, a surface shape of a retainer ring is measured, and the polishing condition of the substrate is determined based on the measured surface shape, and thus it is possible to reduce influence by a variation or change with time of the surface shape of the retainer ring.

The polishing device may further include a substrate delivery apparatus for loading the substrate onto the substrate holding member and/or unloading the substrate from the substrate holding member, and the sensor may measure the surface shape of the retaining ring when the substrate is delivered between the substrate holding member and the substrate delivery apparatus. According to this configuration, the surface shape of the retaining ring is measured when the substrate is delivered, and thus it is possible to measure the surface shape of the retaining ring each time one or a plurality of substrates is replaced.

In the polishing device, the sensor may measure a shape of a bottom face of the retaining ring. According to this configuration, it is possible to suppress influence on a polishing profile due to a variation in shape of a bottom face of each of retaining rings according to a condition of precision during a machining operation when the retaining rings are manufactured.

In the polishing device, the sensor may measure a whole diameter of the bottom face of the retaining ring. According to this configuration, it is possible to measure a whole shape in a radial direction of the bottom face of the retaining ring.

In the polishing device, the sensor may measure a shape of half or more of the bottom face of the retaining ring on an inner circumference side in the radial direction. According to this configuration, it is possible to measure the shape of half or more of the bottom face of the retaining ring on the inner circumference side in the radial direction.

In the polishing device, the sensor may measure a shape of an inner circumferential surface of the retaining ring. According to this configuration, it is possible to suppress influence on the polishing profile due to change with time of the shape when the substrate comes into contact with the inner circumferential surface of the retaining ring by the use.

In the polishing device, the sensor may be one of an ultrasonic sensor, an eddy current sensor, an optical sensor, and a contact sensor. According to this configuration, it is possible to preferably measure the surface shape of the retaining ring.

In the polishing device, the substrate delivery apparatus may include a support that supports a portion of the bottom face of the retaining ring, and the sensor may measure the surface shape of the retaining ring having the bottom face, the portion of which is supported by the support. According to this configuration, it is possible to measure the surface shape of the retaining ring having the bottom face supported by the support.

In the polishing device, the support may have a notch, and the sensor may be disposed in the notch to measure the shape of the bottom face of the retaining ring. According to this configuration, it is possible to measure the shape of the bottom face of the retaining ring having the bottom face supported by the support.

In the polishing device, the sensor may measure a shape in the radial direction of the bottom face of the retaining ring. According to this configuration, it is possible to measure a variation in shape in the radial direction of the bottom face of the retaining ring.

In the polishing device, the sensor may measure a shape in the radial direction of the retaining ring by performing a measurement while moving in the radial direction of the retaining ring. According to this configuration, it is possible to measure the shape in the radial direction of the bottom face of the retaining ring by scanning a small sensing range.

In the polishing device, the sensor may be a line sensor or an area sensor extending in the radial direction of the retaining ring. According to this configuration, it is possible to measure the shape in the radial direction of the bottom face of the retaining ring at a high speed.

In the polishing device, a plurality of sensors may be disposed side by side in the radial direction of the retaining ring. According to this configuration, it is possible to measure the shape in the radial direction of the bottom face of the retaining ring at a high speed.

In the polishing device, the plurality of sensors may be disposed side by side in a circumferential direction of the retaining ring. According to this configuration, it is possible to measure a shape in the circumferential direction of the bottom face of the retaining ring.

In the polishing device, the controller may correct an inclination of the retaining ring based on a result of the measurement performed by the sensor. According to this configuration, it is possible to correct the inclination of the retaining ring held on the substrate holding member.

The polishing device may further include a cleaner that removes extraneous matter on the measured surface of the retaining ring. According to this configuration, it is possible to obtain a measurement result with a high accuracy since the surface of the retaining ring is cleaned.

The polishing device may further include a cleaner that removes extraneous matter on the sensor. According to this configuration, it is possible to obtain a measurement result with a high accuracy since the sensor is cleaned.

The polishing device may further include a temperature sensor that detects a temperature of the measured surface of the retaining ring, and a cooler that cools the retaining ring such that the temperature of the measured surface of the retaining ring remains constant based on the temperature detected by the temperature sensor. According to this configuration, the temperature of the retaining ring is controlled, and thus the measurement of the surface shape of the retaining ring is stable.

The polishing device may further include a calibration ring, and the controller may calibrate a result of measuring the surface shape of the retaining ring based on a result obtained when the sensor measures a surface shape of the calibration ring. According to this configuration, it is possible to automatically calibrate a detection value of the sensor.

In the polishing device, the measured surface of the calibration ring may have a flatness less than or equal to 5

μm. According to this configuration, it is possible to calibrate the sensor at a high accuracy.

In the polishing device, the substrate holding member may be rotatable, and the controller may control a rotation phase of the substrate holding member such that the sensor and the retaining ring have a predetermined positional relation when the surface shape of the retaining ring is measured. According to this configuration, even when grooves are formed on the retaining ring, it is possible to measure a surface shape of a position excluding the grooves or an arbitrary position of a place including the grooves.

A polishing method of an embodiment includes a polishing process of polishing a substrate by relatively moving the substrate and a polishing pad in a state in which the substrate is surrounded by a retaining ring and pressed against the polishing pad, a measurement process of measuring a surface shape of the retaining ring, and a control process of determining a polishing condition in the polishing process based on the surface shape of the retaining ring measured in the measurement process. In the polishing process the substrate is polished according to the polishing condition determined in the control process. According to this configuration, the surface shape of the retainer ring is measured, and the polishing condition of the substrate is determined based on the measured surface shape, and thus it is possible to reduce influence due to a variation or change with time of the surface shape of the retainer ring.

Hereinafter, a description will be given of the polishing device according to the embodiment of the present technology with reference to drawings. FIG. 1 is a diagram schematically illustrating an overall configuration of the polishing device according to the embodiment of the present technology. As illustrated in FIG. 1, the polishing device includes a polishing table 100 and a polishing head 1 serving as a substrate holding apparatus that holds a substrate W such as a semiconductor wafer corresponding to an object to be polished and presses the substrate W against a polishing surface on the polishing table 100. The polishing table 100 is connected to a motor (not illustrated) disposed below the polishing table 100 through a table shaft 100*a*. The polishing table 100 rotates around the table shaft 100*a* when the motor rotates.

A polishing pad 101 serving as a polishing member is attached to an upper surface of the polishing table 100. A surface 101*a* of the polishing pad 101 is included in the polishing surface that polishes the substrate W. A polishing liquid supply nozzle 70 is installed above the polishing table 100. A polishing liquid (polishing slurry) Q is supplied onto the polishing pad 101 on the polishing table 100 from the polishing liquid supply nozzle 70.

Various polishing pads are commercially available. Examples thereof include SUBA800, IC-1000 and IC-1000/SUBA400 (two-layer cloth) manufactured by Nitta Haas Incorporated, Surfin xxx-5 and Surfin 000 manufactured by Fujimi Incorporated. Each of SUBA800, Surfin xxx-5 and Surfin 000 is a nonwoven fabric fabricated by solidifying a fiber with a urethane resin, and IC-1000 is hard foamed polyurethane (single layer). Foamed polyurethane is porous, and has a plurality of minute hollows or holes on a surface thereof.

The polishing head 1 basically includes a polishing head main body 2 that presses the substrate W against a polishing surface 101*a*, and a retainer ring 3 serving as the retaining ring that surrounds a peripheral edge of the substrate W to prevent the substrate W from protruding from the polishing head 1. The polishing head 1 is connected to a polishing head shaft 111. The polishing head shaft 111 moves up and down with respect to a polishing head arm 110 by a vertical motion mechanism 124. The polishing head 1 is positioned in a vertical direction by moving the entire body of the polishing head 1 up and down with respect to the polishing head arm 110 by a vertical motion of the polishing head shaft 111. A rotary joint 25 is attached to an upper end of the polishing head shaft 111.

The vertical motion mechanism 124 that moves the polishing head shaft 111 and the polishing head 1 up and down includes a bridge 128 that rotatably supports the polishing head shaft 111 through a bearing 126, a ball screw 132 attached to the bridge 128, a support 129 supported by a fulcrum 130, and an alternating current (AC) servomotor 138 provided on the support 129. The support 129 that supports the servomotor 138 is fixed to the polishing head arm 110 through the fulcrum 130.

The ball screw 132 includes a screw shaft 132*a* connected to the servomotor 138 and a nut 132*b* to which the screw shaft 132*a* is screwed. The polishing head shaft 111 moves up and down by being integrated with the bridge 128. Therefore, when the servomotor 138 is driven, the bridge 128 moves up and down through the ball screw 132, thereby moving the polishing head shaft 111 and the polishing head 1 up and down.

In addition, the polishing head shaft 111 is connected to a tumbling barrel 112 through a key (not illustrated). The tumbling barrel 112 includes a timing pulley 113 in an outer circumferential part thereof. A rotary motor for polishing head 114 is fixed to the polishing head arm 110, and the timing pulley 113 is connected to a timing pulley 116 provided to the rotary motor for polishing head 114 through a timing belt 115. Thus, when the rotary motor for polishing head 114 is rotated, the tumbling barrel 112 and the polishing head shaft 111 are rotated in an integrated manner through the timing pulley 116, the timing belt 115, and the timing pulley 113, and the polishing head 1 is rotated.

The polishing head arm 110 is supported by a polishing head arm shaft 117 which is rotatably supported by a frame (not illustrated). The polishing device includes a controller 500 for controlling each of apparatuses in the device including the rotary motor for polishing head 114, the servomotor 138, and a polishing table rotary motor.

Figure 2:
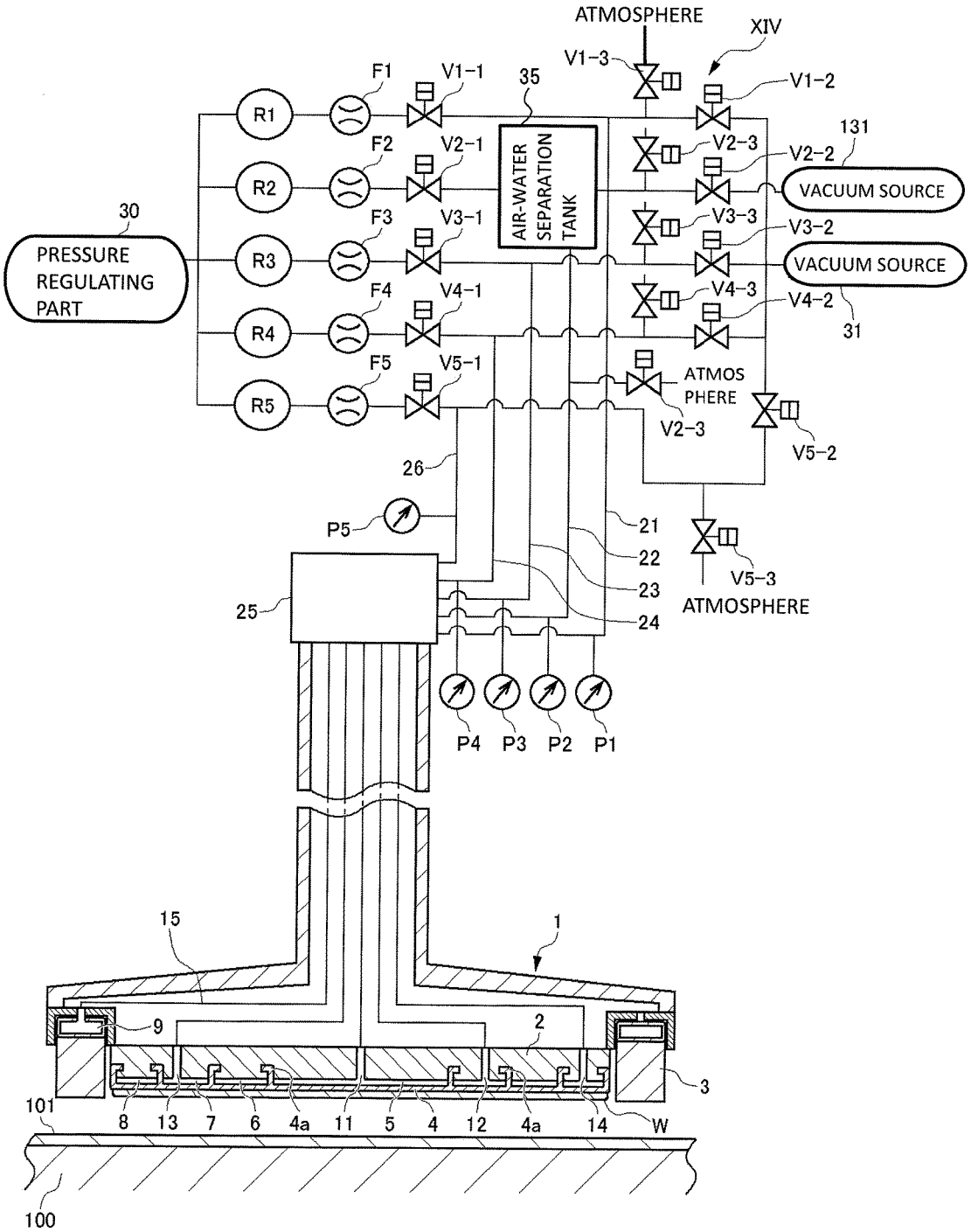
FIG. 2 is a cross-sectional view schematically illustrating a polishing head according to an embodiment.

Next, a description will be given of the polishing head 1 in the polishing device. FIG. 2 is a cross-sectional view schematically illustrating the polishing head 1 serving as the substrate holding apparatus that holds the substrate W corresponding to an object to be polished and presses the substrate W against the polishing surface on the polishing table 100. FIG. 2 illustrates only main components included in the polishing head 1.

As illustrated in FIG. 2, the polishing head 1 basically includes the polishing head main body (also referred to as a carrier) 2 that presses the substrate W against the polishing surface 101*a*, and the retainer ring 3 serving as a retainer member that directly presses the polishing surface 101*a*. The polishing head main body (carrier) 2 includes a substantially disk-shaped member, and the retainer ring 3 is attached to an outer circumferential part of the polishing head main body 2.

The polishing head main body 2 is made of a resin such as engineering plastic (for example, polyether ether ketone (PEEK)). An elastic membrane 4 that comes into contact with a rear surface of a semiconductor wafer is attached to a lower surface of the polishing head main body 2. The elastic membrane 4 is made of a rubber material which is excellent in strength and durability such as ethylene-propylene rubber (EPDM), polyurethane rubber, silicone rubber.

The elastic membrane 4 is included in a substrate holding surface that holds a substrate such as the semiconductor wafer.

The elastic membrane 4 includes a plurality of concentric partitions 4*a*, which form a circular center chamber 5, a ring-shaped ripple chamber 6, a ring-shaped outer chamber 7 and a ring-shaped edge chamber 8 between an upper surface of the elastic membrane 4 and a lower surface of the polishing head main body 2. In other words, the center chamber 5 is formed at a central part of the polishing head main body 2, and the ring-shaped ripple chamber 6, the ring-shaped outer chamber 7 and the ring-shaped edge chamber 8 are concentrically formed in order from a center toward an outer circumference. A flow passage 11 communicating with the center chamber 5, a flow passage 12 communicating with the ripple chamber 6, a flow passage 13 communicating with the outer chamber 7 and a flow passage 14 communicating with the edge chamber 8 are respectively formed in the polishing head main body 2.

The flow passage 11 communicating with the center chamber 5, the flow passage 13 communicating with the outer chamber 7 and a flow passage 14 communicating with the edge chamber 8 are connected to flow passages 21, 23 and 24, respectively, through the rotary joint 25. The flow passages 21, 23 and 24 are connected to a pressure regulating part 30 through valves V1-1, V3-1 and V4-1 and pressure regulators R1, R3 and R4, respectively. In addition, the flow passages 21, 23 and 24 are connected to a vacuum source 31 through valves V1-2, V3-2 and V4-2, respectively, and capable of communicating with atmosphere through valves V1-3, V3-3 and V4-3, respectively.

Meanwhile, the flow passage 12 communicating with the ripple chamber 6 is connected to the flow passage 22 through the rotary joint 25. The flow passage 22 is connected to the pressure regulating part 30 through an air-water separation tank 35, a valve V2-1 and a pressure regulator R2. In addition, the flow passage 22 is connected to a vacuum source 131 through the air-water separation tank 35 and a valve V2-2, and capable of communicating with atmosphere through a valve V2-3.

In addition, a retainer ring pressure chamber 9 is formed by an elastic membrane 32 immediately above the retainer ring 3. The elastic membrane 32 is accommodated in a cylinder 33 which is fixed to a flange part of the polishing head 1. The retainer ring pressure chamber 9 is connected to a flow passage 26 through a flow passage 15 formed in the polishing head main body (carrier) 2 and the rotary joint 25. The flow passage 26 is connected to the pressure regulating part 30 through a valve V5-1 and a pressure regulator R5. In addition, the flow passage 26 is connected to the vacuum source 31 through a valve V5-2, and capable of communicating with atmosphere through a valve V5-3.

Each of the pressure regulators R1, R2, R3, R4 and R5 has a pressure regulating function for regulating a pressure of a pressure fluid supplied from the pressure regulating part 30 to each of the center chamber 5, the ripple chamber 6, the outer chamber 7, the edge chamber 8 and the retainer ring pressure chamber 9. The pressure regulators R1, R2, R3, R4 and R5 and the respective valves V1-1 to V1-3, V2-1 to V2-3, V3-1 to V3-3, V4-1 to V4-3, V5-1 to V5-3 are connected to the controller 500 (see FIG. 1) such that operations of the pressure regulators and the valves are controlled. In addition, pressure sensors P1, P2, P3, P4 and P5 and flow sensors F1, F2, F3, F4 and F5 are installed on the flow passages 21, 22, 23, 24 and 26, respectively.

Respective pressures of fluids supplied to the center chamber 5, the ripple chamber 6, the outer chamber 7, the edge chamber 8 and the retainer ring pressure chamber 9 are independently regulated by the pressure regulating part 30 and the pressure regulators R1, R2, R3, R4 and R5. According to this configuration, it is possible to regulate a pressing force applied to press the substrate W against the polishing pad 101 for each region of the semiconductor wafer, and regulate a pressing force applied by the retainer ring 3 to press the polishing pad 101.

Next, a description will be given of a series of polishing treatment processes performed by the polishing device configured as illustrated in FIGS. 1 and 2. The polishing head 1 receives the substrate W from a pusher 150 (see FIG. 3 and the like), and holds the substrate W by vacuum suction. A plurality of holes (not illustrated) for vacuum suction of the substrate W are provided in the elastic membrane 4, and the holes communicate with the vacuum source. The polishing head 1 holding the substrate W by vacuum suction is lowered to a position set during polishing of a top ring which is set in advance.

At the position set during polishing, the retainer ring 3 is grounded on the surface (polishing surface) 101*a* of the polishing pad 101. However, before polishing, the substrate W is sucked and held by the polishing head 1, and thus a slight gap (for example, about 1 mm) is formed between a lower surface (polished surface) of the substrate W and the surface (polishing surface) 101*a* of the polishing pad 101. In this instance, the polishing table 100 and the polishing head 1 are rotated together. In this state, a pressure fluid is supplied to each of pressure chambers to inflate the elastic membrane 4 on a rear surface side of the substrate such that the lower surface (polished surface) of the substrate W comes into contact with the surface (polishing surface) of the polishing pad 101, and the polishing table 100 and the polishing head 1 are relatively moved, thereby starting to polish the substrate W.

A pressure of a fluid supplied to each of pressure chambers 5, 6, 7, 8 and 9 is regulated under control of the controller 500 to regulate a pressing force applied to press the substrate W against the polishing pad 101 for each region of the substrate and regulate a pressing force applied by the retainer ring 3 to press the polishing pad 101, and polishing is performed until the surface of the substrate is in a predetermined state (for example, until the surface has a predetermined thickness). After the wafer treatment process on the polishing pad 101 is completed, the substrate W is sucked onto the polishing head 1, and the polishing head 1 is raised and moves to the pusher 150 (see FIG. 3 and the like), and the substrate W is separated.

Figure 3:
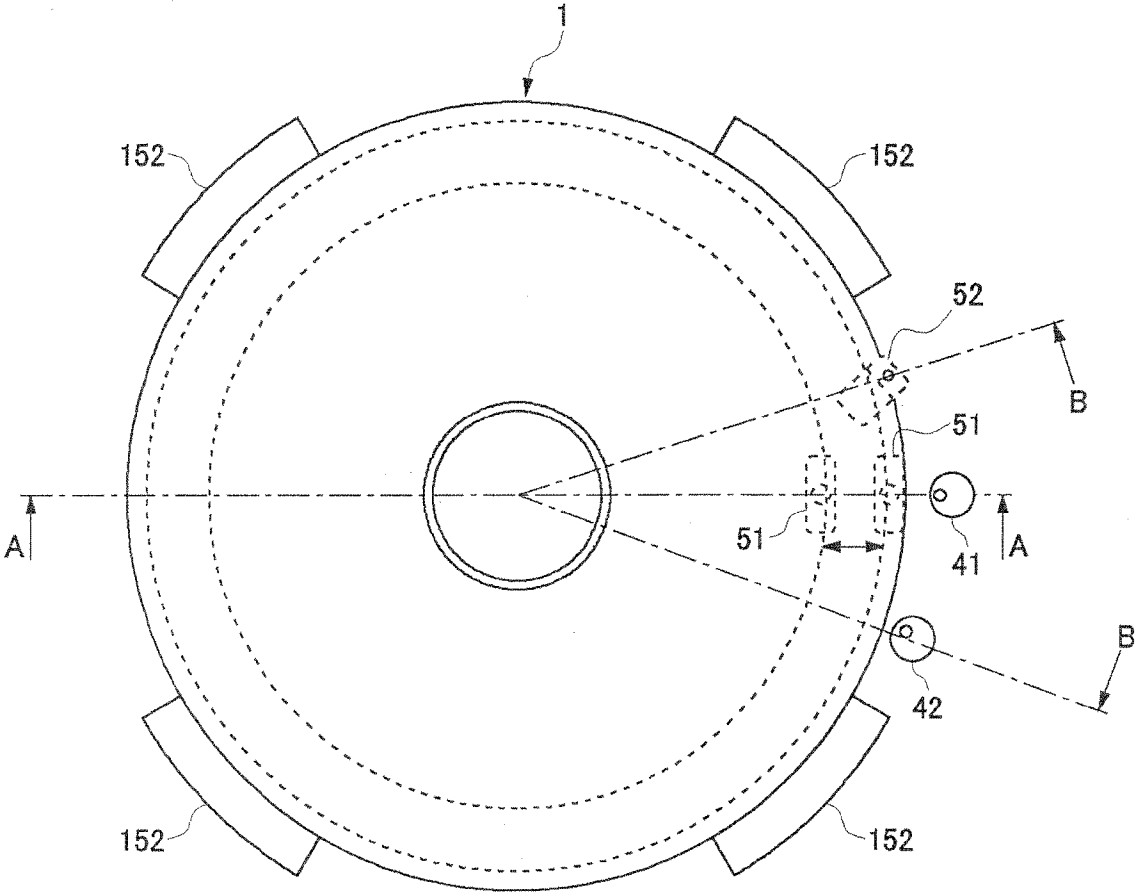
FIG. 3 is a plan view schematically illustrating a polishing head and a pusher according to an embodiment.
Figure 4:
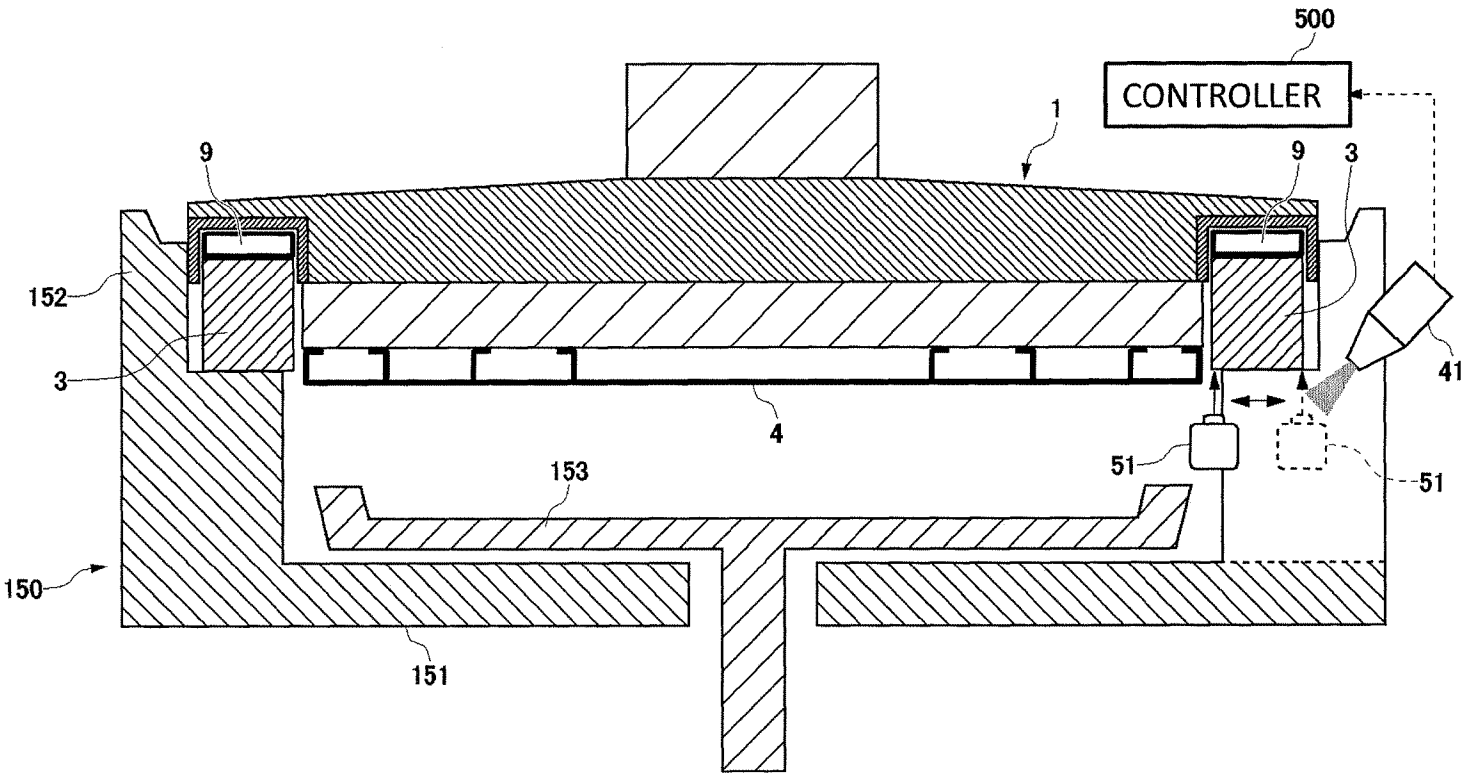
FIG. 4 is a cross-sectional view taken along line A-A of FIG. 3.
Figure 5:
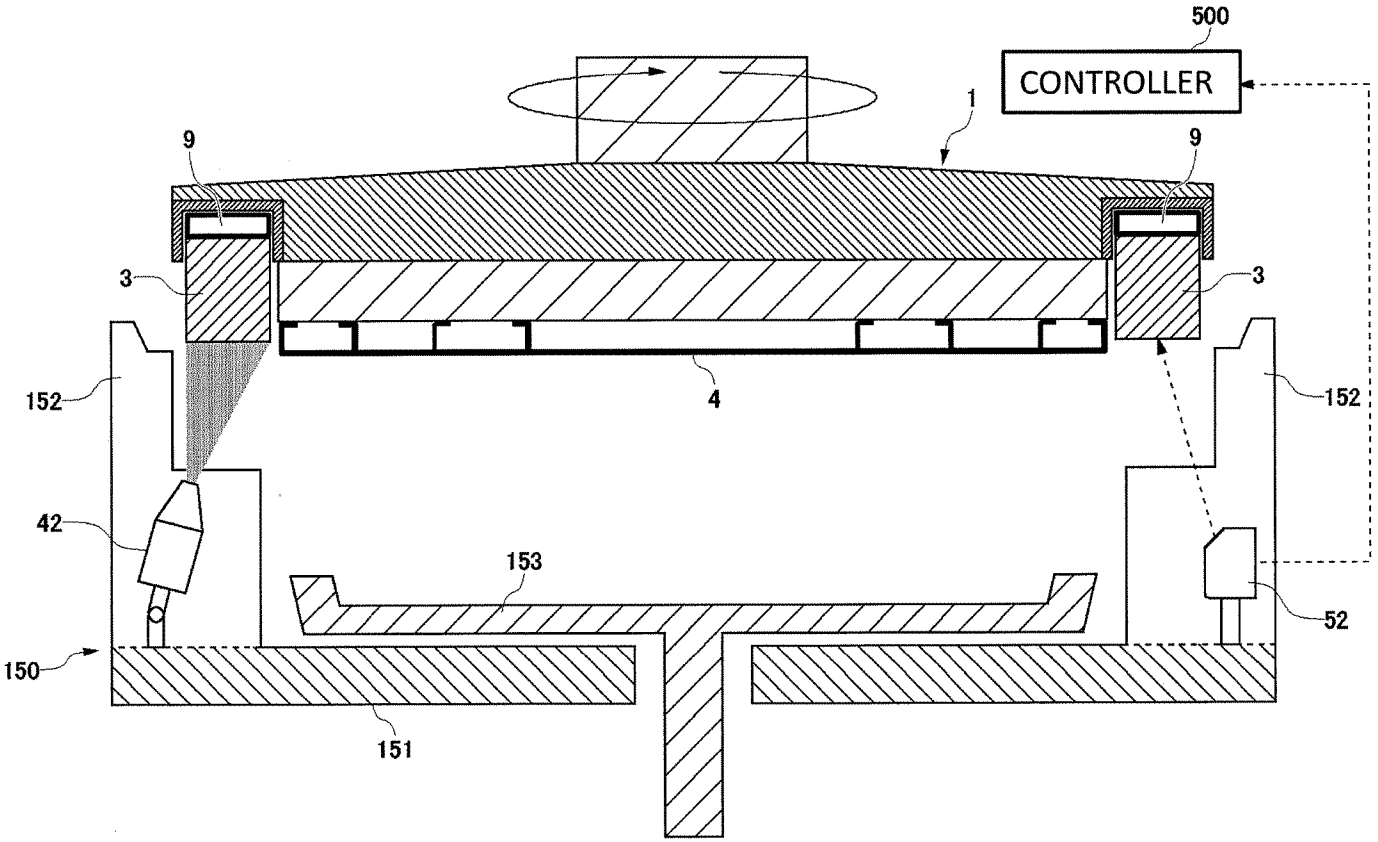
FIG. 5 is a cross-sectional view taken along line B-B of FIG. 3.

FIG. 3 is a plan view schematically illustrating the polishing head 1 and the pusher 150, FIG. 4 is a cross-sectional view taken along line A-A of FIG. 3, and FIG. 5 is a cross-sectional view taken along line B-B of FIG. 3. Although the substrate W is not illustrated in FIGS. 4 and 5, FIG. 4 illustrates a state in which the pusher 150 is raised to deliver the substrate W between the polishing head 1 and the pusher 150, and FIG. 5 illustrates a state in which the pusher 150 is lowered. The pusher 150 is used to load the substrate W onto the polishing head 1, and unload the substrate W from the polishing head 1. A pusher that loads the substrate W onto the polishing head 1 and a pusher that unloads the substrate W from the polishing head 1 may be configured as separate pushers.

As illustrated in FIGS. 3 and 4, the pusher 150 includes a polishing head guide 151 having a support 152 that may be fit to an outer peripheral surface of the polishing head 1 to perform centering between the pusher 150 and the polishing head 1, a pusher stage 153 for supporting the substrate when the substrate is delivered between the polishing head 1 and the pusher 150, an air cylinder (not illustrated) for moving the pusher stage 153 up and down, and an air cylinder (not illustrated) for moving the pusher stage 153 and the polishing head guide 151 up and down.

When the substrate W is delivered between the polishing head 1 and the pusher 150, the polishing head 1 moves up above the pusher 150, and then the pusher stage 153 and the polishing head guide 151 of the pusher 150 are raised, and the support 152 of the polishing head guide 151 is fit to an outer peripheral surface of the retainer ring 3 to perform centering of the polishing head 1 and the pusher 150. In this instance, the support 152 pushes up a bottom face of the retainer ring 3. At the same time, the support 152 vacuates the retainer ring pressure chamber 9, thereby rapidly raising the retainer ring 3.

When the pusher 150 is completely raised, the bottom face of the retainer ring 3 is pressed against an upper surface of the support 152 and pushed up above a lower surface of the membrane 4. Thus, a portion between the substrate W and the membrane 4 is exposed. In an example illustrated in FIG. 4, the bottom face of the retainer ring 3 is positioned 1 mm above the lower surface of the membrane 4. Thereafter, vacuum suction of the substrate W by the polishing head 1 is suspended, and a substrate release operation is performed. A desired positional relation may be obtained by lowering the polishing head 1 instead of raising the pusher 150.

In order to rigorously control a rebound state of the polishing pad 101 in a portion near an edge of the substrate W in the above-described polishing, both a pressure (hereinafter, referred to as a "retainer ring pressure", also written as "RRP") applied to the retainer ring 3 by the retainer ring pressure chamber 9 and a 3D shape of a surface of the retainer ring 3 need to be controlled. In this regard, as illustrated in FIGS. 3 to 5, in the polishing device of the present embodiment, the pusher 150 includes a measurement sensor 51 serving as a measuring unit, a temperature sensor 52 serving as a temperature detecting unit, an air nozzle 41 serving as a cleaner of the measurement sensor 51, and a temperature control air nozzle 42 serving both as a cleaner and a cooler of the retainer ring 3, as a configuration for measuring the 3D shape of the surface of the retainer ring 3.

The measurement sensor 51 measures a surface shape of the retainer ring 3, specifically, a shape of the bottom face. As illustrated in FIG. 3, the support 152 of the polishing head guide 151 has notches in the circumferential direction. In this way, the support 152 is divided into four parts. The measurement sensor 51 is disposed in a position of the notches so as to avoid interference of the support 152 to measure the shape of the bottom face of the retainer ring 3 from below. The measurement sensor 51 is a non-contact ranging sensor that measures a distance from the measurement sensor 51 to the bottom face of the retainer ring 3.

The measurement sensor 51 measures a whole diameter of the retainer ring 3 by moving a measurement position in a radial direction of the retainer ring 3. To achieve this, the measurement sensor 51 is movable in the radial direction of the retainer ring 3 by a driving mechanism (not illustrated) such that the measurement position is moved in the radial direction from an inside edge up to an outside edge of the bottom face of the retainer ring 3. When distances from the measurement sensor 51 to a plurality of points on the surface of the retainer ring 3 are measured by the measurement sensor 51, the 3D shape of the surface of the retainer ring 3 is obtained. The measurement sensor 51 is specifically an optical (laser) sensor. However, in addition to the optical sensor, an eddy current sensor, an ultrasonic sensor, and the like may be adopted as the non-contact ranging sensor. In addition, the measurement sensor 51 may be a contact-type sensor such as a dial gauge.

The air nozzle 41 blows (sprays) pressurized air on the measurement sensor 51 to remove extraneous matter (slurry, water drop, water screen, and the like) attached to a surface of the measurement sensor 51. Specifically, the air nozzle 41 blows pressurized air toward an energy delivery opening of the measurement sensor 51 to remove extraneous matter from the energy delivery opening using a wind pressure when the measurement sensor 51 is at an initial position before moving in the radial direction of the retainer ring 3 as described above. Here, the energy delivery opening corresponds to a laser emitting opening when the measurement sensor 51 is the optical (laser) sensor.

Information about the 3D shape of the bottom face of the retainer ring 3 measured by the measurement sensor 51 is sent to the controller 500. The controller 500 determines an RRP for the substrate W thereafter based on a result of measurement sent from the measurement sensor 51, and polishes the substrate W. In other words, the controller 500 converts the information about the measured 3D shape of the bottom face of the retainer ring 3 into an RRP setting value using a predetermined algorithm, and controls an RRP according to the RRP setting value obtained as described above when the substrate W is polished thereafter. For example, when the bottom face of the retainer ring 3 has a shape in which an inner circumference side protrudes than an outer circumference side, the RRP tends to be effective, and thus the controller 500 performs a control operation of setting the RRP to a relatively low value. On the other hand, when the outer circumference side protrudes than the inner circumference side, the RRP tends to be ineffective, and thus the controller 500 performs a control operation of setting the RRP to a relatively high value.

As illustrated in FIG. 5, the temperature sensor 52 is a non-contact sensor which is used when the pusher 150 is lowered to detect a temperature of the bottom face corresponding to a measured surface of the retainer ring 3. As illustrated in FIG. 5, the temperature control air nozzle 42 is used when the pusher 150 is lowered to blow (spray) pressurized air on the bottom face of the retainer ring 3, thereby removing extraneous matter (slurry, water drop, water screen, and the like) attached to the bottom face corresponding to the measured surface of the retainer ring 3. In this way, a function of the temperature control air nozzle 42 that removes extraneous matter corresponds to a cleaner. When air is sprayed, the bottom face of the retainer ring 3 is cooled. A function of the temperature control air nozzle 42 that cools the retainer ring corresponds to a cooler.

Information about the temperature of the bottom face of the retainer ring 3 measured by the temperature sensor 52 is sent to the controller 500. The controller 500 controls time for spraying air by the temperature control air nozzle 42 based on a result of measurement sent from the temperature sensor 52. Specifically, through feedback control, the controller 500 continues to spray air by the temperature control air nozzle 42 until a temperature of the bottom face of the retainer ring 3 measured by the temperature sensor 52 decreases to be less than or equal to a predetermined temperature, and suspends spraying air by the temperature control air nozzle 42 when the temperature of the bottom face of the retainer ring 3 becomes less than the predetermined temperature.

In this way, the retainer ring 3 is maintained at a predetermined temperature since a resin is generally used for the retainer ring 3, and the resin has a great linear expansion coefficient, and thus the shape of the retainer ring 3 is easily affected by a temperature. In order to decrease or exclude a change of the surface shape due to influence of a temperature as described above, air is blown by the temperature control air nozzle 42 as described above such that a temperature at which the surface shape is measured is constant or becomes less than or equal to a predetermined temperature.

As described in the foregoing, according to the polishing device of the present embodiment, regardless of an initial 3D shape (at the time of shipment) of the bottom face of the retainer ring 3, or regardless of the 3D shape of the bottom face that variously changes when polishing is performed under various polishing conditions, it is possible to obtain a constant polishing profile at an edge portion of the substrate W.

Figure 6:
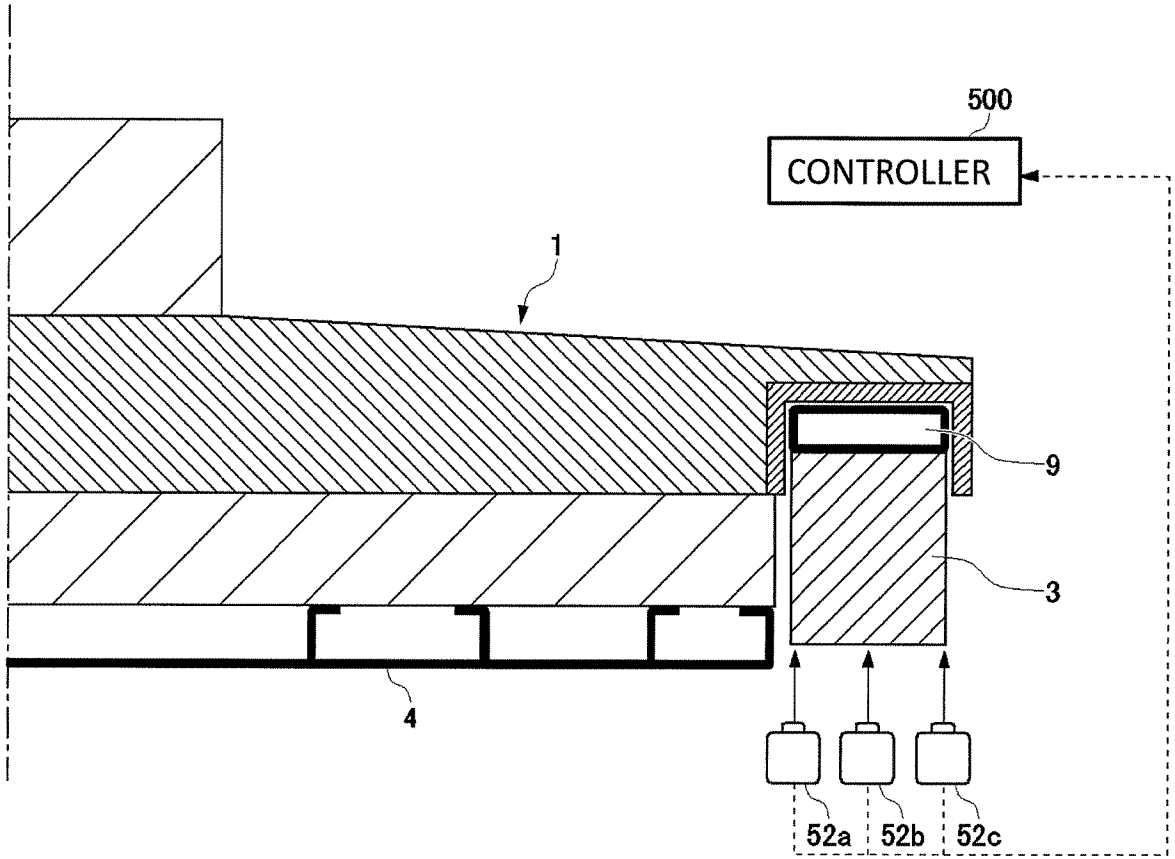
FIG. 6 is a cross-sectional view illustrating a modified example of a measuring unit according to an embodiment.

FIG. 6 is a cross-sectional view illustrating a modified example of the measuring unit, and corresponds to FIG. 4. As illustrated in FIG. 6, in the present modified example, three measurement sensors 52*a* to 52*c* are disposed side by side in the radial direction of the retainer ring 3. Each of the measurement sensors 52*a* to 52*c* has the same configuration as that of the measurement sensor 51. Each of the measurement sensors 52*a* to 52*c* is disposed at a fixed position. According to the present modified example, the measurement sensors 52*a* to 52*c* may not be moved, and thus a driving mechanism therefor is unnecessary. It is possible to detect a shape of the bottom face of the retainer ring 3 by comparing results of measurements of distances of three points without moving each of the measurement sensors 52*a* to 52*c*. Other configurations are similar to the above embodiments. In this way, according to the present modified example, since the plurality of measurement sensors 52*a* to 52*c* are provided in the radial direction of the retainer ring 3, it is possible to exclude the driving mechanism for driving the measurement sensors of the retainer ring 3 to obtain the 3D shape of the bottom face of the retainer ring 3.

Each of the measurement sensors 52*a* to 52*c* may be movable in the radial direction of the retainer ring 3. When each of the three measurement sensors 52*a* to 52*c* is movable in the radial direction, it is possible to expedite the measurement of the 3D shape of the bottom face of the retainer ring 3.

Figure 7:
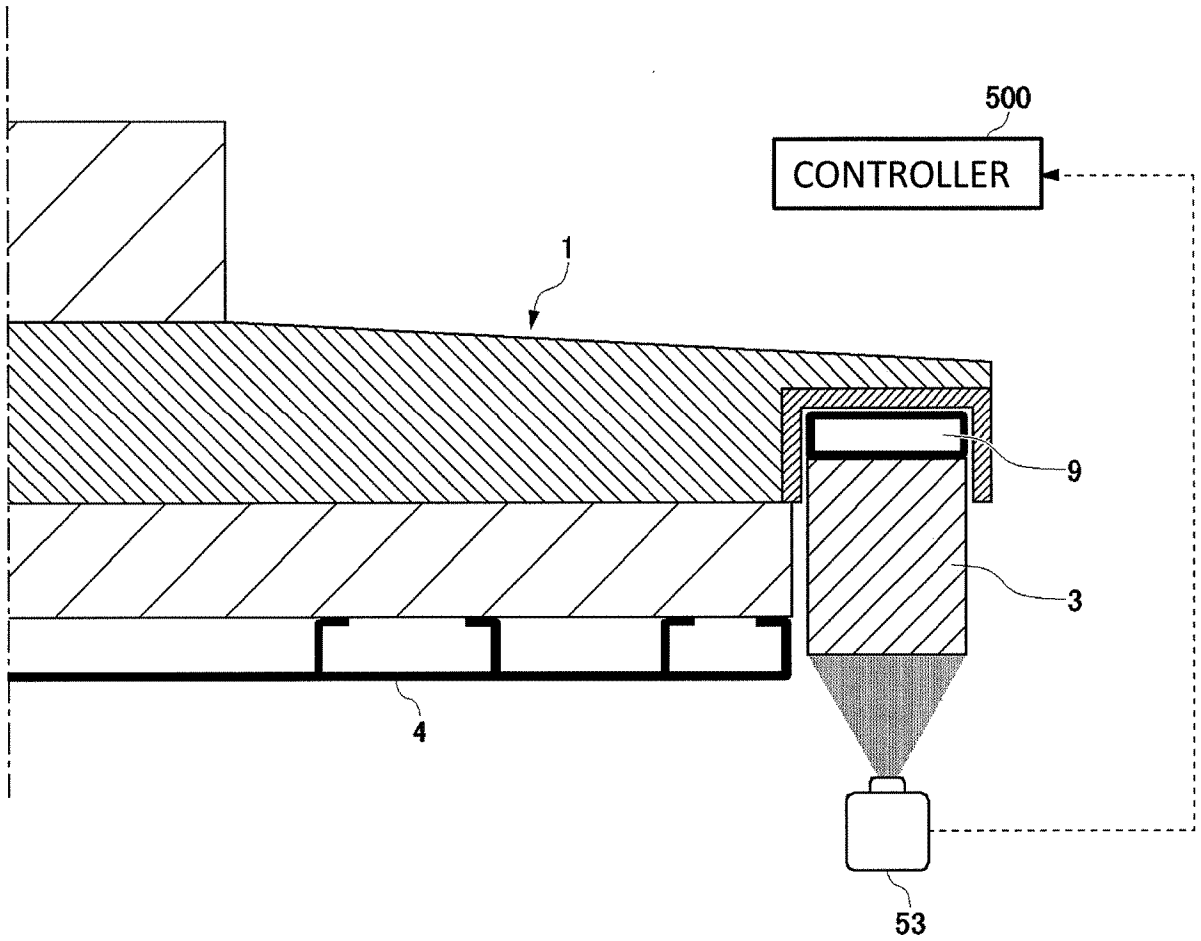
FIG. 7 is a cross-sectional view illustrating another modified example of the measuring unit according to another embodiment.

FIG. 7 is a cross-sectional view illustrating another modified example of the measuring unit, and corresponds to FIG. 4. As illustrated in FIG. 7, the present modified example employs a line sensor as a measurement sensor 53 to simultaneously measure distances to a plurality of points arranged in a linear shape. The line sensor may correspond to an area sensor that simultaneously measures distances to a plurality of points arranged in a two-dimensional (2D) shape. A measurement range of the measurement sensor 53 ranges from an inside edge to an outside edge of the bottom face of the retainer ring 3.

According to the present modified example, the measurement sensor 53 may not be moved, and thus a driving mechanism therefor is unnecessary, and a position of the measurement sensor 53 is fixed. It is possible to detect a shape of the bottom face of the retainer ring 3 based on results of measurements of distances to the plurality of points arranged in the linear shape or the 2D shape without moving the measurement sensor 53. Other configurations are similar to the above embodiments. According to the present modified example, the measurement sensor 53 having a measurement range in the radial direction of the retainer ring 3 is provided, and thus there is no need to move one measurement sensor in the radial direction to obtain the 3D shape of the bottom face of the retainer ring 3, and there is no need to provide a plurality of measurement sensors.

Figure 8:
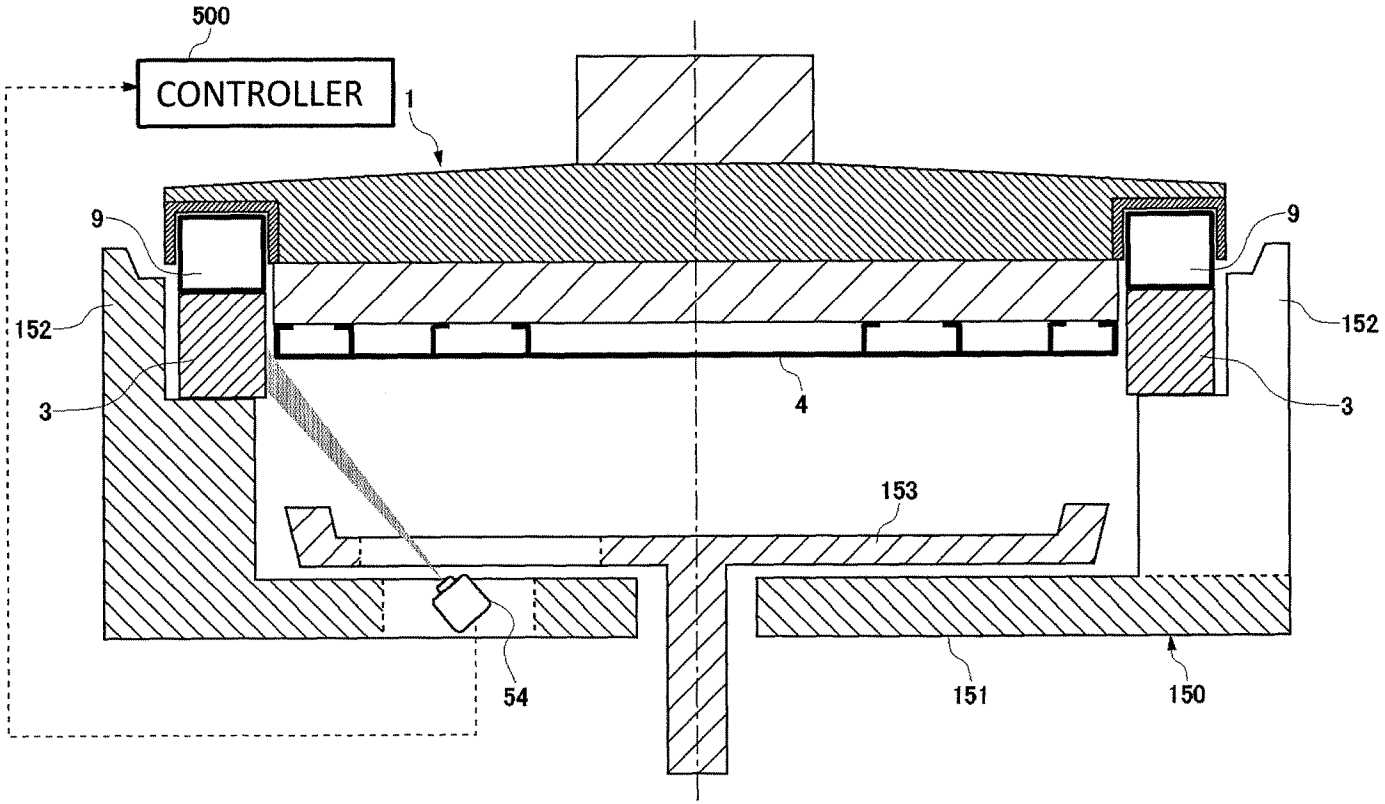
FIG. 8 is a cross-sectional view illustrating another modified example of the measuring unit according to another embodiment.

FIG. 8 is a cross-sectional view illustrating another modified example of the measuring unit, and corresponds to FIG. 4. As illustrated in FIG. 8, in the present modified example, a measurement sensor 54 measures a 3D shape of an inner circumferential surface of the retainer ring 3. To this end, the measurement sensor 54 is disposed in the pusher 150, and a visual field of measurement is set to an outward and obliquely upward visual field.

As described in the foregoing, when the pusher 150 is completely raised and the substrate W is delivered between the membrane 4 and the pusher stage 153, the retainer ring pressure chamber 9 is vacuumized, and the substrate W and the membrane 4 are exposed below the bottom face of the retainer ring 3. However, to measure a shape of the inner circumferential surface of the retainer ring 3 using a configuration illustrated in FIG. 8 after the substrate W is delivered, the retainer ring pressure chamber 9 is depressurized in a state in which the retainer ring 3 is supported by the support 152 of the polishing head guide 151. In this way, the membrane 4 is lifted up, and the inner circumferential surface of the retainer ring 3 is exposed to the measurement sensor 54.

The measurement sensor 54 is a line sensor that measures the inner circumferential surface of the retainer ring 3 from a middle position to a lower end. The measurement sensor 54 may be an area sensor having a measurement range extended in a circumferential direction of the retainer ring 3. A result of measurement performed by the measurement sensor 54 is sent to the controller 500. The measurement sensor 54 may be used together with the measurement sensors 51, 52*a* to 52*c*, and 53.

A description will be given of significance of measuring the shape of the inner circumferential surface of the retainer ring 3. According to a given polishing condition, grooves are formed in the inner circumferential surface of the retainer ring 3 due to contact with the edge portion of the substrate W. The edge portion of the substrate W may be excessively polished when an edge of the substrate W is fit to the groove during polishing, and a portion of the RRP is applied to the edge of the substrate W. In the present modified example, when the groove resulting in excessive polishing of the edge portion of the substrate W is measured on the inner circumferential surface of the retainer ring 3 by the measurement sensor 54, the controller 500 changes the polishing condition such that the RRP is set to a relatively low value. In addition, if a depth of the groove exceeds a certain value, a polishing shape of the substrate is not restored even when the polishing condition is changed. Besides, the substrate may slip out during polishing. Thus, the controller 500 activates an alarm or interlock to urge replacement of the retainer ring 3.

Figure 9:
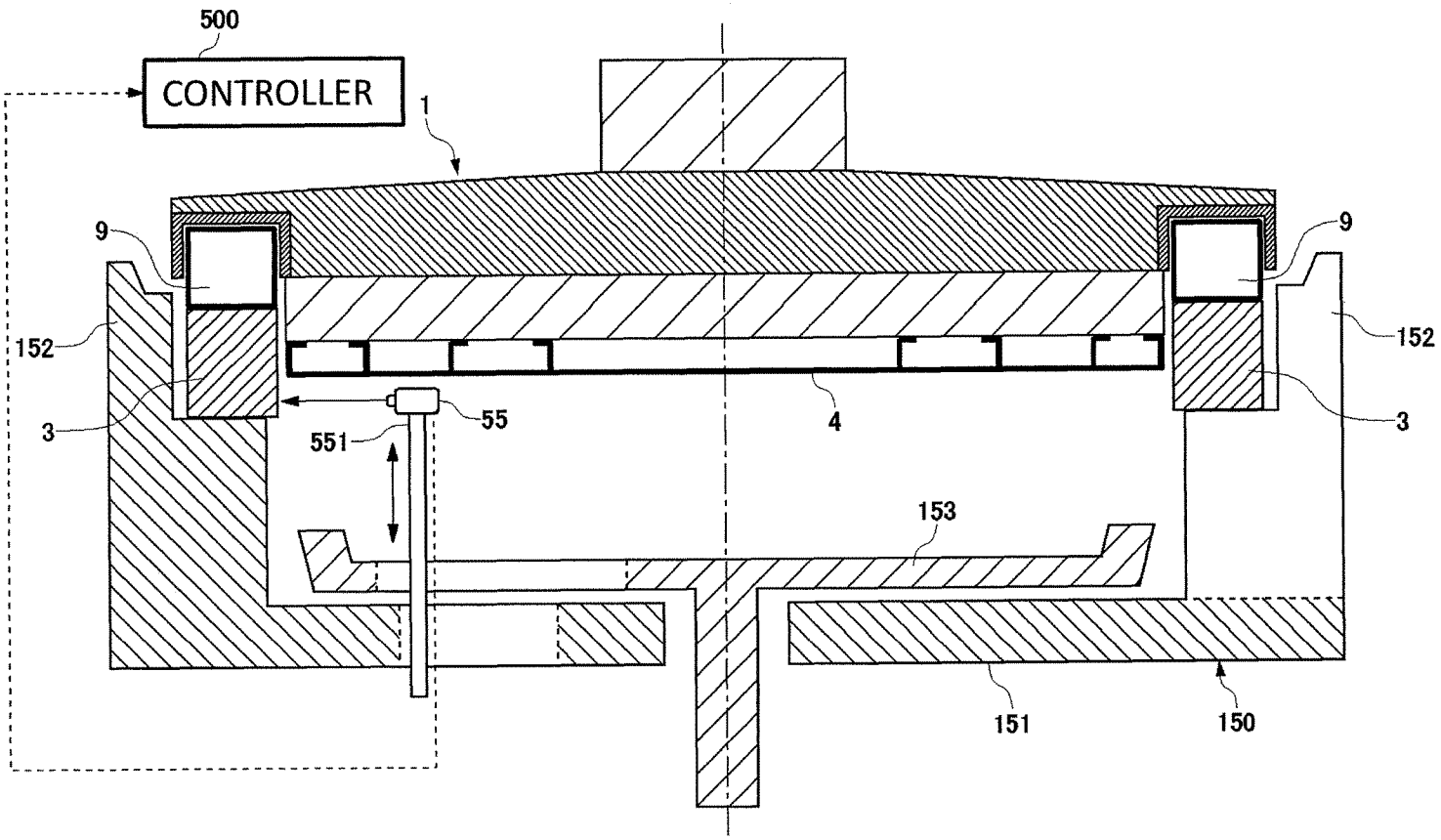
FIG. 9 is a cross-sectional view illustrating another modified example of the measuring unit according to another embodiment.

FIG. 9 is a cross-sectional view illustrating another modified example of the measuring unit that measures the inner circumferential surface of the retainer ring 3. In the example of FIG. 8, the position of the measurement sensor 54 is fixed, and the shape of the inner circumferential surface of the retainer ring 3 is measured from below. However, in the present modified example, a measurement sensor 55 is attached to a tip of an elevating lift 551, and the shape of the inner circumferential surface of the retainer ring 3 exposed as described above is measured when the elevating lift 551 is moved up and down.

When the substrate W is delivered, the elevating lift 551 is lowered such that the measurement sensor 55 is lowered to a position lower than at least the pusher stage 153. In this way, delivery of the substrate W between the membrane 4 and the pusher stage 153 is not interfered. Other configurations are similar to the example of FIG. 8.

Figure 10:
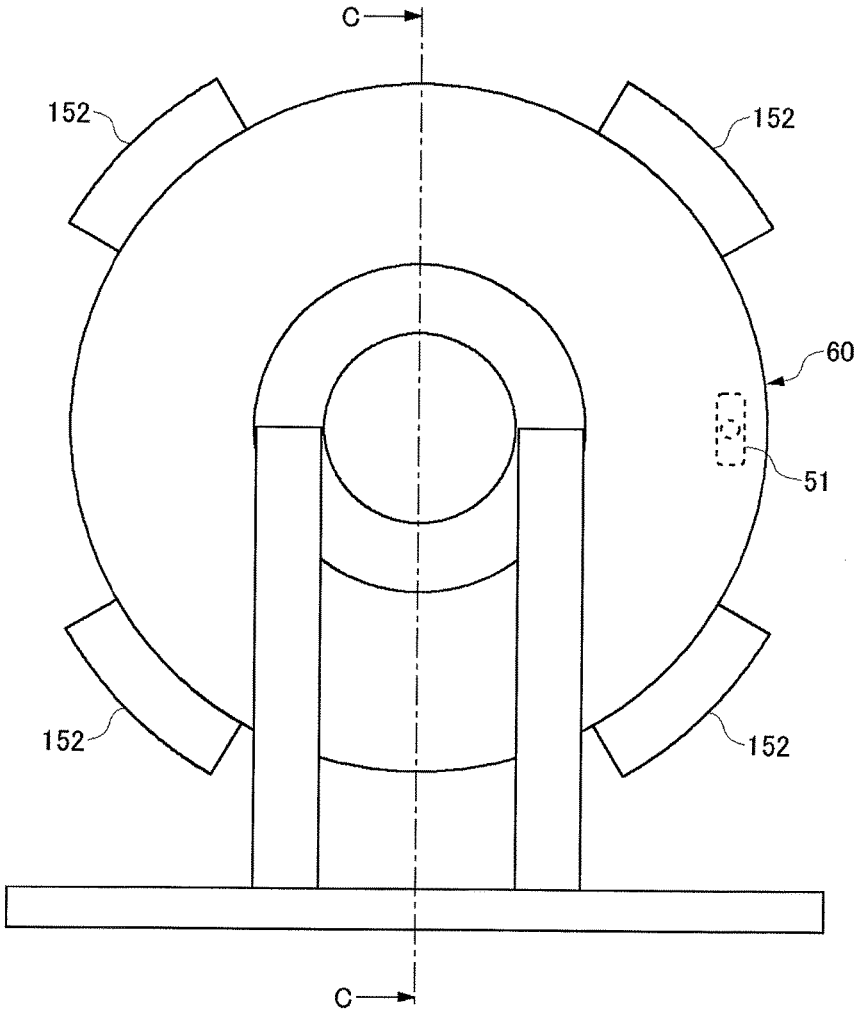
FIG. 10 is a plan view illustrating a reference ring installed on the pusher according to an embodiment.
Figure 11:
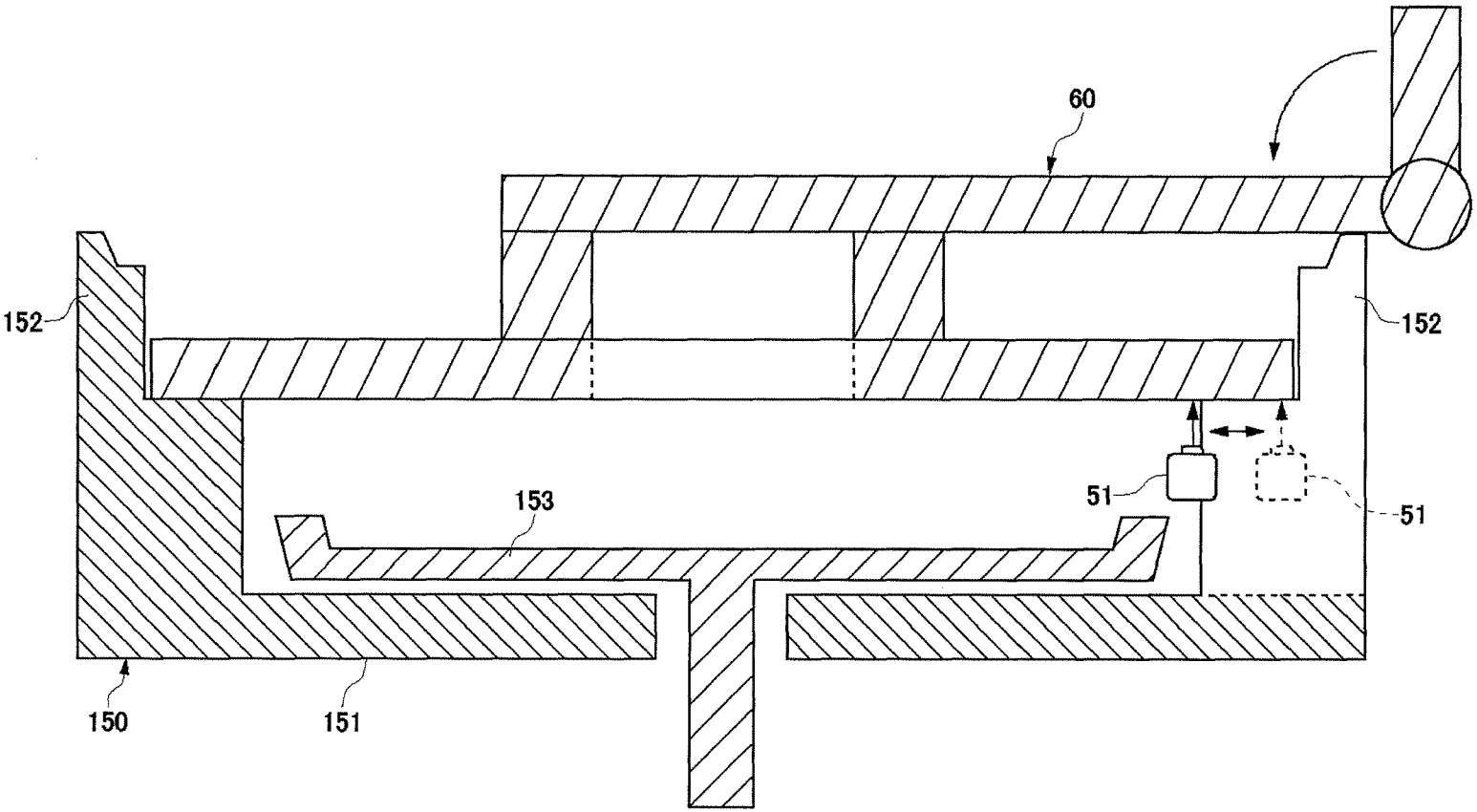
FIG. 11 is a cross-sectional view taken along line C-C of FIG. 10.

Next, a description will be given of automatic calibration of each of the measurement sensors 51, 52*a* to 52*c*, 53, 54 and 55 described above. FIG. 10 is a plan view illustrating a reference ring installed on the pusher 150, and FIG. 11 is a cross-sectional view taken along line C-C of FIG. 10. The measurement sensors are automatically calibrated by the reference ring 60 serving as a calibration ring at certain intervals. An example of FIGS. 10 and 11 illustrates a configuration in which the measurement sensor 51 is employed.

The reference ring 60 is fixed to avoid a turning course of the polishing head 1, and configured to be movable up to the support 152 of the polishing head guide 151 when the polishing head 1 is located at a position other than the pusher 150, for example, on the polishing pad 101. The reference ring 60 has a shape of a ring, and has an edge portion held by the four parts of the support 152 of the polishing head guide 151 similarly to the retainer ring 3. It is preferable that a flatness of at least a measured surface of the reference ring 60 be less than or equal to 5 μm.

A result of measuring the reference ring 60 is sent to the controller 500. The controller 500 calibrates a subsequent measurement result of the measurement sensor 51 using the result of measuring the reference ring 60 as a reference value. In this way, even when there is a change with time due to use of the measurement sensor 51, it is possible to measure the surface shape of the retainer ring 3 at a high accuracy by correcting the change.

As described in the foregoing, according to the embodiments and the modified examples thereof, the substrate W is pressed against the polishing pad 101, the substrate W pressed against the polishing pad 101 is surrounded by the retainer ring 3, the surface shape of the retainer ring is measured using the measurement sensor 51 and the like, and the controller 500 determines the polishing condition of the substrate W based on the measured surface shape of the retainer ring 3. Thus, it is possible to calculate an optimal polishing condition by the controller 500 based on the surface shape of the retainer ring 3 to polish the substrate thereafter. Accordingly, it is possible to reduce influence on polishing of the substrate W due to a variation or change with time of the surface shape of the retainer ring 3.

In the above embodiments and the modified examples thereof, a distance from the measurement sensor is measured with respect to a plurality of points in the radial direction of the retainer ring 3. However, a plurality of points in a circumferential direction may be measured by a driving sensor, a plurality of sensors, or a sensor that simultaneously measures a plurality of points. In this way, when the plurality of points in the circumferential direction are measured, the points may be statistically handled (for example, averaged) to be used as a measured value of a surface shape (distance from the measurement sensor) at each of diameters. In this way, it is possible to equalize variations of the measured value in the circumferential direction.

In addition, it is possible to measure an inclination of the retainer ring 3 with respect to a sensor by measuring distances of three or more positions of the bottom face of the retainer ring 3 using at least three sensors disposed in the circumferential direction. The controller 500 may correct a distribution of distances of the bottom face of the retainer ring 3 based on the measurement.

In addition, grooves for allowing passage of slurry and the like supplied during polishing may be formed on the bottom face of the retainer ring 3. The grooves are formed from the inside edge up to the outside edge of the bottom face of the retainer ring 3. The controller 500 may control a rotation phase of the retainer ring 3 such that the measurement sensor may measure a surface shape of a position excluding the grooves. Further, when a surface shape of a position including the grooves are actively measured by the measurement sensor, the controller 500 may control a rotation phase of the retainer ring 3 such that the grooves are included in a measurement range of the measurement sensor.

In addition, instead of providing a plurality of measurement sensors in the circumferential direction of the retainer ring 3 as described above, the controller 500 may perform measurement a plurality of times while rotating the retainer ring 3 and changing a rotation phase.

In addition, in the above embodiments and the modified examples thereof, the whole diameter of the bottom face of the retainer ring 3 is measured. However, only a portion in the radial direction of the bottom face may be set to a measurement range and measured. For example, referring to a measurement range, only a portion on an inner circumference side of the retainer ring 3 may be measured. In this case, a width in a radial direction of the measurement range may be half or more a width in the radial direction of the bottom face of the retainer ring 3. In addition, in this case, at least two or more positions in the circumferential direction may be measured by taking a variation in the circumferential direction into account.

What is claimed is:

1. A polishing device comprising:

a substrate holding member configured to press a substrate against a polishing pad and have a retaining ring surrounding the substrate pressed against the polishing pad;

a sensor configured to measure a surface shape of an inner circumferential surface of the retaining ring; and a controller configured to determine a polishing condition of the substrate based on the surface shape of the retaining ring measured by the sensor, wherein the sensor is arranged inside of the inner circumferential surface of the retaining ring in the horizontal direction and is arranged obliquely upward or substantially horizontally.

2. The polishing device according to claim 1, further comprising a substrate delivery apparatus configured to load the substrate onto the substrate holding member or unload the substrate from the substrate holding member, wherein the sensor measures the surface shape of the retaining ring when the substrate is delivered between the substrate holding member and the substrate delivery apparatus.

3. The polishing device according to claim 2, wherein the substrate delivery apparatus includes a support supporting a portion of the bottom face of the retaining ring, and the sensor measures the surface shape of the retaining ring, the portion of the bottom face of the retaining ring being supported by the support.

4. The polishing device according to claim 3, wherein the support has a notch, and the sensor is disposed in the notch to measure the shape of the bottom face of the retaining ring.

5. The polishing device according to claim 1, wherein the sensor measures a shape of a bottom face of the retaining ring.

6. The polishing device according to claim 5, wherein the sensor measures a whole diameter of the bottom face of the retaining ring.

7. The polishing device according to claim 5, wherein the sensor measures a shape of half or more of the bottom face of the retaining ring on an inner circumference side in a radial direction.

8. The polishing device according to claim 1, wherein the sensor is one of an ultrasonic sensor, an eddy current sensor, an optical sensor, and a contact sensor.

9. The polishing device according to claim 1, wherein the sensor measures a shape in a radial direction of the bottom face of the retaining ring.

10. The polishing device according to claim 9, wherein the sensor measures a shape in the radial direction of the retaining ring by performing a measurement while moving in the radial direction of the retaining ring.

11. The polishing device according to claim 9, wherein the sensor is a line sensor or an area sensor extending in the radial direction of the retaining ring.

12. The polishing device according to claim 9, wherein a plurality of sensors are disposed side by side in the radial direction of the retaining ring.

13. The polishing device according to claim 1, wherein a plurality of sensors are disposed side by side in a circumferential direction of the retaining ring.

14. The polishing device according to claim 13, wherein the controller corrects an inclination of the retaining ring based on a result of the measurement performed by the sensor.

15. The polishing device according to claim 1, further comprising a cleaner configured to remove extraneous matter on the measured surface of the retaining ring.

16. The polishing device according to claim 1, further comprising a cleaner configured to remove extraneous matter on the sensor.

17. The polishing device according to claim 1, further comprising:

a temperature sensor configured to detect a temperature of the measured surface of the retaining ring; and a cooler configured to cool the retaining ring such that the temperature of the measured surface of the retaining ring remains constant based on the temperature detected by the temperature sensor.

18. The polishing device according to claim 1, further comprising a calibration ring, wherein the controller calibrates a result of measuring the surface shape of the retaining ring based on a result obtained when the sensor measures a surface shape of the calibration ring.

19. The polishing device according to claim 18, wherein the measured surface of the calibration ring has a flatness less than or equal to 5 μm.

20. The polishing device according to claim 1, wherein the substrate holding member is rotatable, and the controller controls a rotation phase of the substrate holding member such that the sensor and the retaining ring have a predetermined positional relation when the surface shape of the retaining ring is measured.

21. A polishing method comprising:

a polishing process of polishing a substrate by relatively moving the substrate and a polishing pad in a state in which the substrate is surrounded by a retaining ring and pressed against the polishing pad;

a measurement process of measuring, with a sensor, a surface shape of an inner circumferential surface of the retaining ring; and a control process of determining a polishing condition in the polishing process based on the surface shape of the retaining ring measured in the measurement process, wherein in the polishing process, the substrate is polished according to the polishing condition determined in the control process, and the sensor is arranged inside of the inner circumferential surface of the retaining ring in the horizontal direction and is arranged obliquely upward or substantially horizontally.

* * * * *